US009281089B2

(12) United States Patent
Isensee

(10) Patent No.: US 9,281,089 B2
(45) Date of Patent: Mar. 8, 2016

(54) PARENT RADIONUCLIDE CONTAINER

(71) Applicant: NorthStar Medical Radioisotopes LLC, Madison, WI (US)

(72) Inventor: Glenn H. Isensee, Madison, WI (US)

(73) Assignee: NorthStar Medical Radioisotopes LLC, Madison, WI (US)

( * ) Notice: Subject to any disclaimer, the term of this patent is extended or adjusted under 35 U.S.C. 154(b) by 0 days.

(21) Appl. No.: 14/528,670

(22) Filed: Oct. 30, 2014

(65) Prior Publication Data

US 2015/0179289 A1 Jun. 25, 2015

Related U.S. Application Data

(60) Provisional application No. 61/897,489, filed on Oct. 30, 2013.

(51) Int. Cl.

| | |
|---|---|
| ***G21F 5/015*** | (2006.01) |
| ***G21F 5/018*** | (2006.01) |
| ***G21F 5/12*** | (2006.01) |
| ***G21G 1/00*** | (2006.01) |
| *A61J 1/20* | (2006.01) |

(52) U.S. Cl.

CPC ..... *G21F 5/015* (2013.01); *G21F 5/12* (2013.01); *G21G 1/0005* (2013.01); *A61J 1/2096* (2013.01); *G21F 5/018* (2013.01)

(58) Field of Classification Search

CPC ..... G21F 5/015; G21F 5/018
USPC ..... 250/506.1; 976/350, 351; 600/5, 7
See application file for complete search history.

(56) References Cited

U.S. PATENT DOCUMENTS

| | | | | | |
|---|---|---|---|---|---|
| 3,120,613 | A * | 2/1964 | Prest | G21F 5/015 | 250/497.1 |
| 3,673,411 | A * | 6/1972 | Glasser | G21F 5/018 | 250/506.1 |
| 4,020,355 | A * | 4/1977 | Czaplinski | G21F 5/015 | 250/506.1 |
| 4,241,728 | A * | 12/1980 | Mirell | A61M 5/34 | 250/506.1 |
| 4,560,069 | A * | 12/1985 | Simon | B65D 5/509 | 206/523 |
| 4,880,119 | A * | 11/1989 | Simon | B65D 81/09 | 206/584 |
| 7,199,375 | B2 * | 4/2007 | Drobnik | A61L 2/07 | 250/455.11 |
| 2013/0053815 | A1 * | 2/2013 | Mucientes | A61J 1/1406 | 604/414 |

* cited by examiner

*Primary Examiner* — Phillip A Johnston
*Assistant Examiner* — Kevin Chung
(74) *Attorney, Agent, or Firm* — Husch Blackwell LLP

(57) ABSTRACT

A method and apparatus for using a parent radionuclide. The apparatus includes a radiation impervious case, a vial disposed within the case, a stopper with a central bore, the central bore aligned at an oblique angle with respect to the case so that a straight line through the central bore does not pass through any part of the vial and a curved tube that connects the central bore of the stopper and a cap of the vial.

10 Claims, 8 Drawing Sheets

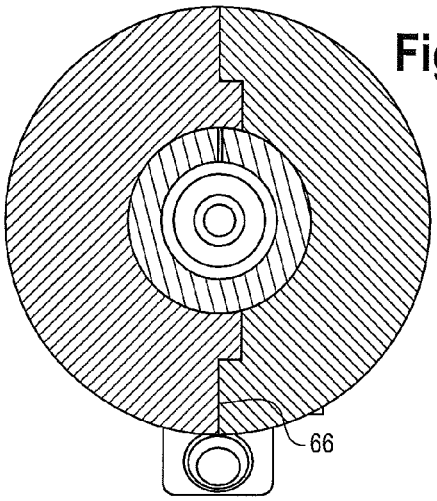
Fig. 5B
Fig. 6A
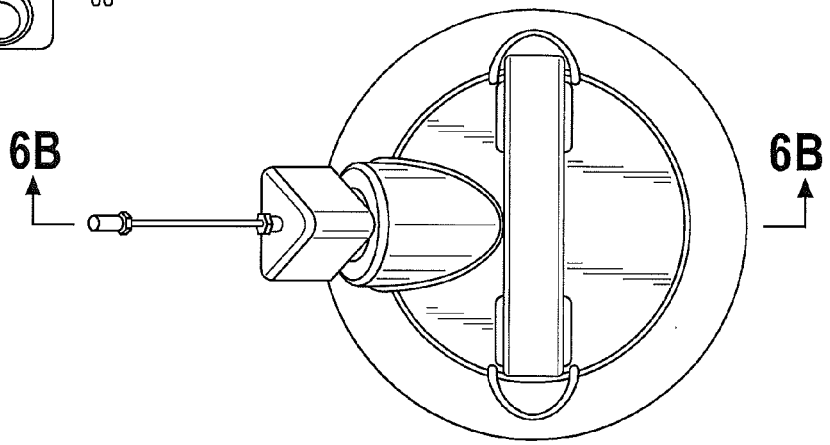
Fig. 6B
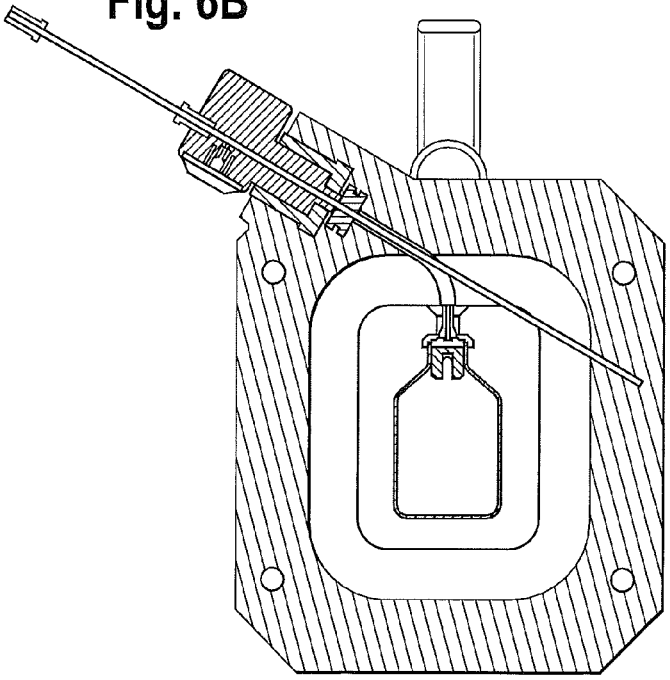

PARENT RADIONUCLIDE CONTAINER

This Application is a continuation-in-part of U.S. Provisional Patent Application No. 61/897,489 filed on Oct. 30, 2013.

FIELD OF THE INVENTION

The field of the invention relates to nuclear medicine and more particularly, to methods of processing radioactive nuclides.

BACKGROUND OF THE INVENTION

The use of radioactive materials in nuclear medicine for therapeutic and diagnostic purposes is known. In the case of diagnostic medicine, radioactive material may be used to track blood flow for purposes of detecting obstructions or the like. In this case the radioactive material (e.g., a tracer) may be injected into a vein of the arm or leg of a person.

A scintillation camera may be used to collect images of the person following the injection. In this case, the gamma rays of the tracer interact with a detector of the camera to create images of the person.

A series of images are collected as the tracer perfuses through the person. Since the tracer diffuses through the blood of the person, the veins or arteries with greater blood flow produce a greater signature from the tracer.

Alternatively, radioactive material may be coupled at a molecular level with a biolocalization agent. In this case, the biolocalization agent may concentrate the radioactive material at some specific location (e.g., the site of a tumor).

Key to the use of radioactive materials in nuclear medicine is the creation of nuclear materials with a relatively short half life (e.g., 2-72 hours). In the case of the use of the radioactive materials with a biolocalization agent or for imaging, the short half life causes the radioactivity to decay rapidly in such as way as to reduce exposure of the person to radiation.

While the use of radioactive materials in nuclear medicine is extremely useful, the handling of such materials can be difficult. Materials with short half lives may require complex separation procedures to isolate the desired material from other materials. Once separated, the desired material must be easily accessible for injection into the patient. Accordingly, a need exists for better methods of handling such materials.

BRIEF DESCRIPTION OF THE DRAWINGS

FIGS. 5A-B are back and a top cut-away views of the parent radionuclide container of FIG. 4;

FIGS. 6A-B are top and cut-away view of the parent radionuclide container of FIG. 4;

DETAILED DESCRIPTION OF AN ILLUSTRATED EMBODIMENT

Figure 1:
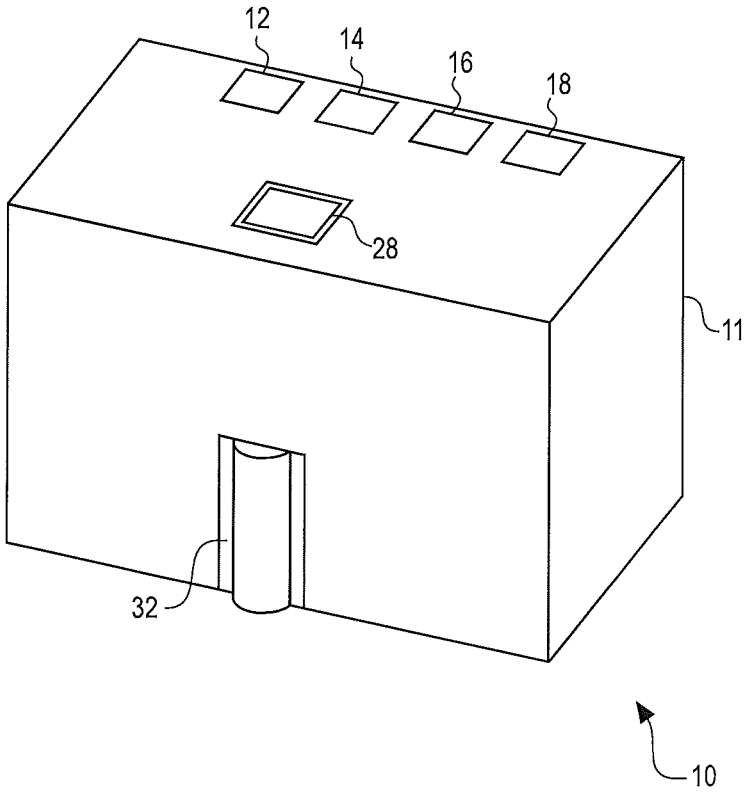
FIG. 1 is a front, perspective view of a device for processing radionuclides shown generally in accordance with an illustrated embodiment of the invention.
Figure 2:
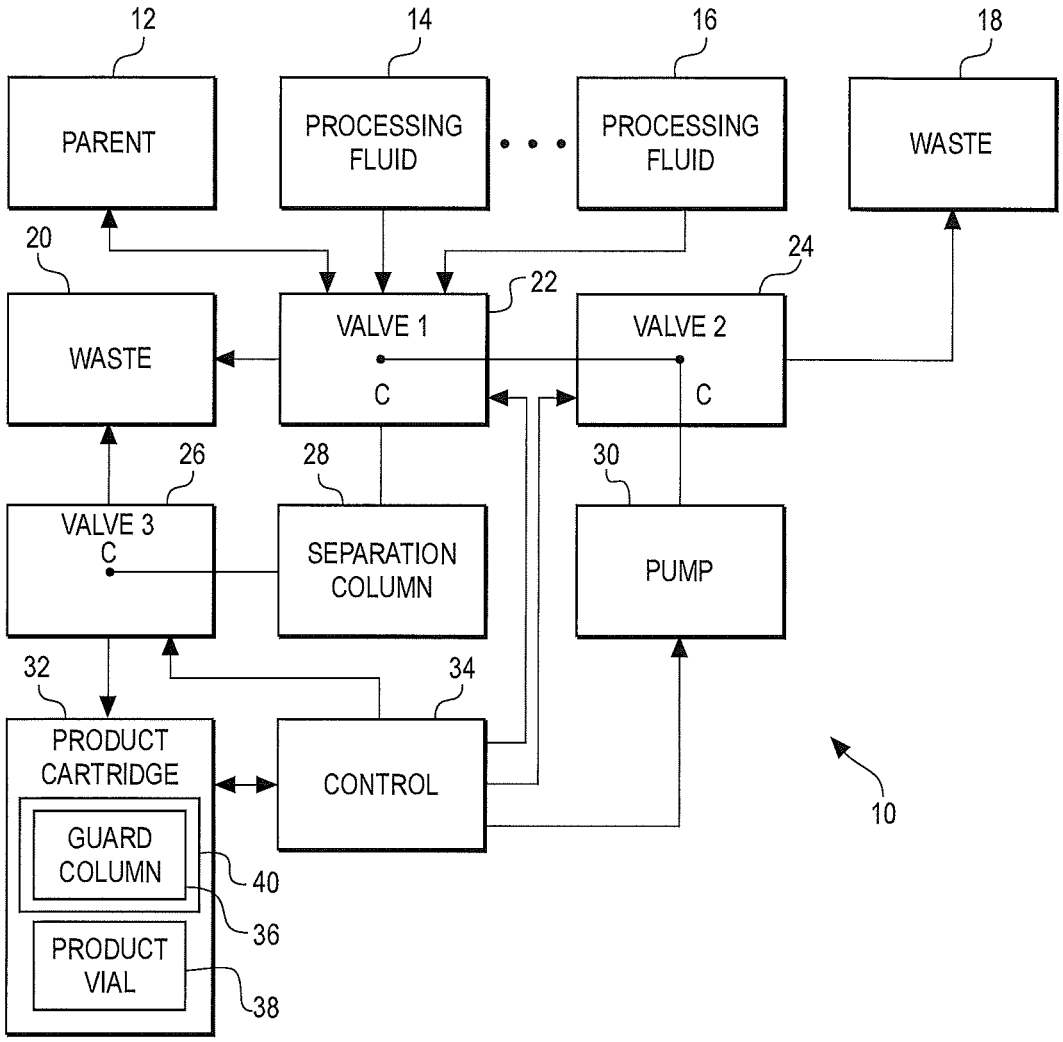
FIG. 2 is block diagram of the processing element of the device of FIG. 1.

FIG. 1 is a front perspective view of the device and system 10 for processing radionuclides shown generally in accordance with an illustrated embodiment of the invention. FIG. 2 is a block diagram of the separation system 10. The system 10 may be used to provide highly pure radioactive materials for use in diagnostic or therapeutic processes. The system 10 may be constructed as a portable device that is simple to use in radionuclide production facilities, nuclear pharmacies or in some other medical environment.

The system 10 may be used to separate a parent radionuclide from a daughter radionuclide using a forward COW process and where the daughter radionuclide is produced by the decay of the parent radionuclide. The system 10 may also be used to separate a daughter radionuclide from a parent radionuclide using a reverse COW process.

Included within the system 10 may be one or more separation columns 28, 36. The separation column 28 may be selected for purification of a wide range of radionuclides depending upon the diagnostic or therapeutic objectives. For example, the separation columns 26, 36 may be filled within a chromatographic material (e.g., ion-exchange resin, extraction chomotographic material, etc.) targeted for the specific radionuclide needed. In this regard, the system 10 may be used for the purification of yttrium-90, bismuth-212 and 213, or rhenium-188 for radiotherapy or technetium-99 m, thallium-201, fluorine-18 or indium-111 for diagnostic imaging.

In this regard, the system 10 may be provided with a parent radionuclide. After some period of time, some of the parent radionuclide will decay to produce a mixture of parent and daughter radionuclides. In this case, a controller 34 of the system 10 may activate one or more valves 22, 24, 26 and a pump 30 to transport the mixture of the parent and daughter radionuclides from a parent radionuclide container 12 to a first separation column 28 that captures the daughter radionuclide. Once the mixture of parent and daughter radionuclides has passed through the separation column 28, the remaining parent may be transported back to the parent container 12.

The controller 34 may wash the first separation column 28 by activating valves 22, 24 to first withdraw a wash solution from a processing fluids container 14, 16 and then to discard the wash solution into a waste container 18, 20. The wash process may be repeated any of a number of times with the same or different types of wash solutions.

Once washed, the controller 34 may withdraw a stripping solution from one of the processing fluids containers 14, 16 and then pump the stripping solution through the first separation column 28, through valve 26 and into the product cartridge assembly 32. The stripping solution functions to release the daughter radionuclide from the separator column 28 and then transport the daughter radionuclide into the product cartridge assembly 32.

Figure 3:
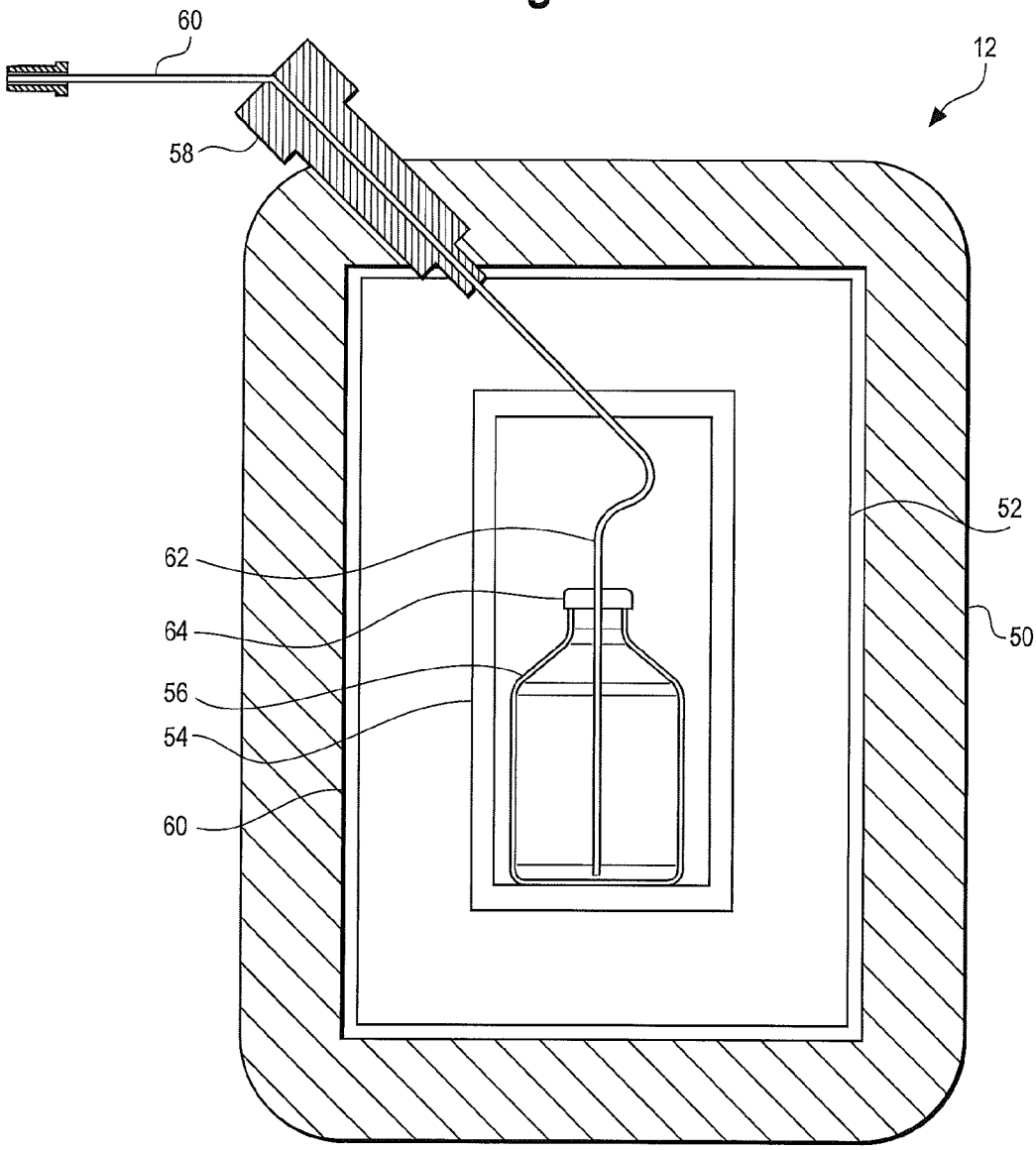
FIG. 3 is a simplified view of the parent radionuclide container of FIG. 2.

FIG. 3 is a simplified view of the storage container 12 of FIG. 2 for a parent radionuclide. The storage unit includes a storage bottle or vial 56 in a radiation resistant case (e.g., lead) 50. The radiation resistant case includes an aperture extending from an exterior into the case with a stopper 58 on an outside of the case extending into the aperture. The stopper and case define a sterile venting channel that couples an interior of the case to the exterior of the case through a filter disposing through a first aperture in the stopper. A fill tube is coupled between a second aperture in the stopper and the storage bottle, the fill tube extends along a portion of the venting channel from the stopper 58 to the storage bottle 56. Once the storage bottle is filled through the fill tube, a plug is inserted into the second aperture to maintain sterility.

To withdraw the parent radionuclide from the case, the sterile tube is removed from its protective package and the plug is removed from the second aperture of the stopper. The sterile tube is then inserted through the second aperture and the fill tube into the storage bottle. The parent radionuclide may then be removed from the storage bottle and case through the sterile tube.

As shown in FIG. 3, the storage container 12 may include one or more layers 50, 52 of shielding of various materials. For example, an inner shield 52 may be of a lighter material (e.g., polyethylene) for low energy particles. An outer shield 50 may be a more dense material (e.g., lead) for high energy particles.

As shown in FIG. 3, the bottle or vial 56 containing the parent radionuclide is disposed inside an inner chamber 54 of the container 12. The stopper 58 extends through the outer shield 50. A first tube 62 extends through the inner shield 52. The first tube 62 extends through a cap 64 of the vial 56 on a first end and connects to the stopper 58 on a second end. The second tube 60 is inserted into and threaded through the stopper 58 and first tube 62 to the bottom of the vial 56. The pump 30 of FIG. 2 withdraws the parent radionuclide from the container 12 through the tube 60.

Figure 4:
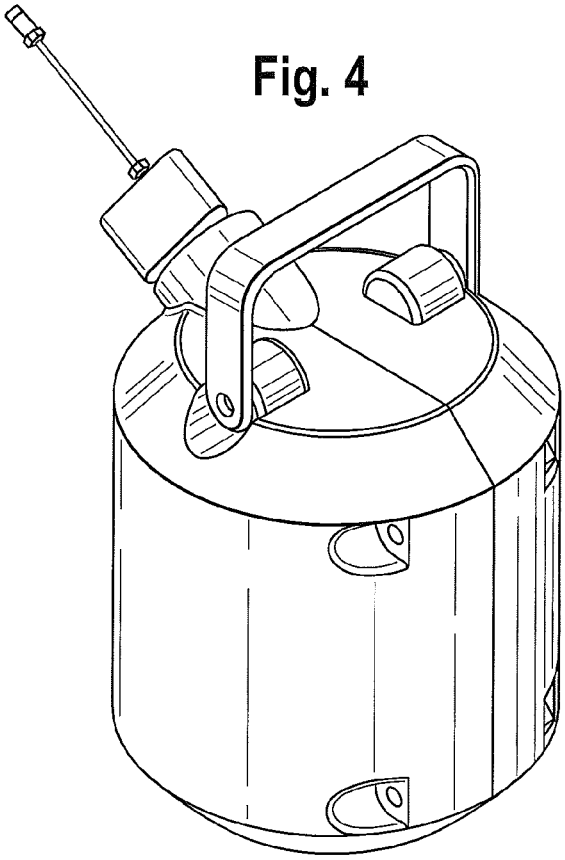
FIG. 4 is a side perspective view of the parent container of FIG. 2.
Figure 5A:
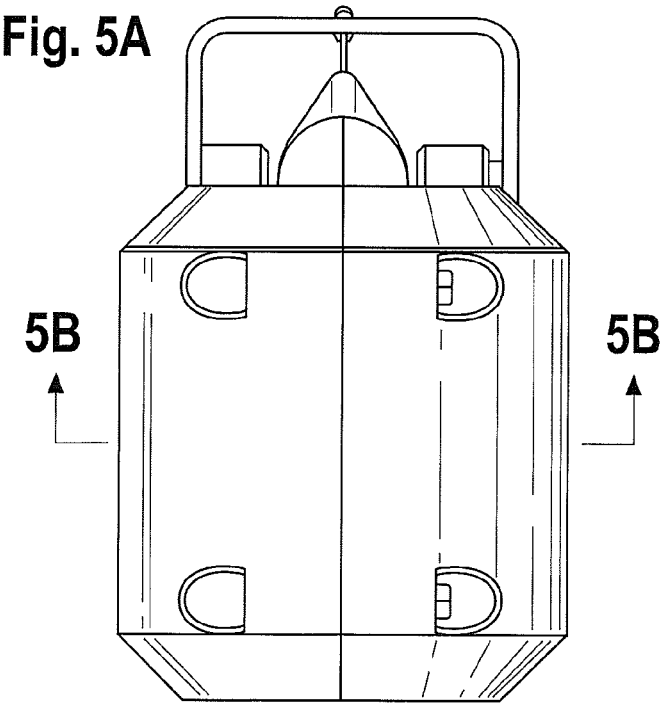

FIG. 4 depicts a side perspective view of the container 12. FIG. 5A is a rear view of the container 12. FIG. 5B is a cut-away view of the container 12 of FIG. 5A along section C-C. FIG. 6A is a top view of the container 12 and FIG. 6B is a cut-away view of the container 12 of FIG. 6A along section A-A. As can be specifically seen in FIGS. 5 and 6, the container 12 is specifically constructed to prevent any form of line-of-sight radiation from exiting the container 12. In this regard, the outer shield 50 has an offset or jog 66 that prevents radiation to escaping the container 12 along the otherwise straight line of the seam between opposing halves of the outer shield 50.

Similarly, the stopper 58 is arranged at an angle that is offset from the vial 56. Offset in this context means that a line passing down through the central bore or channel of the stopper 58 would not pass through any part of the vial 56. In this way radiation cannot propagate in a straight line from the vial 56 and through the central bore of the stopper 58 to irradiate a person handling the container 12.

The first tube 62 is also curved as it extends from the vial 56 to the stopper 58. In this way radiation cannot propagate in a straight line from the vial 56 up the first tube 62 and through the stopper 58. The curve in the first tube 62 further operates to reduce radiation leakage.

Figure 7:
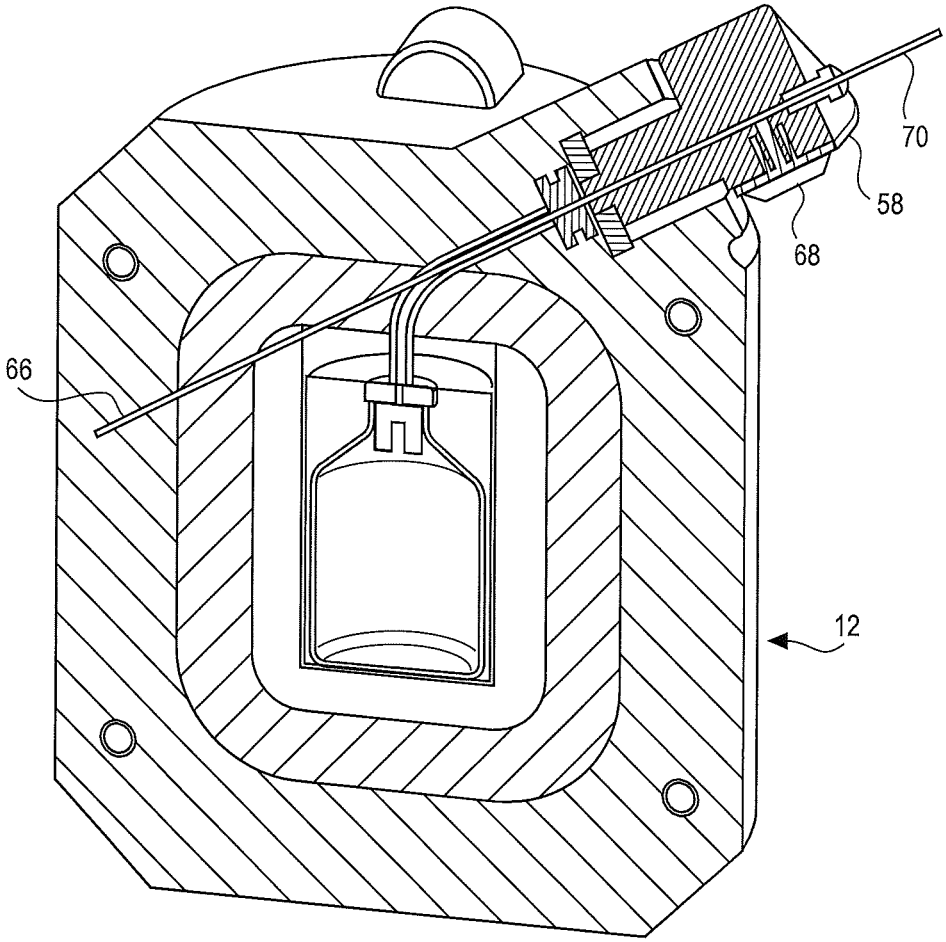
FIG. 7 is an expanded, cut-away view of the parent radionuclide container of FIGS. 4-6.

FIG. 7 is an enlarged cut-away view of the container 12. As shown in FIG. 7, a vent passageway 66 extends diagonally and downwards to the left from the stopper 58. A sterile filter 68 is disposed in the stopper 58 and connects between the vent passageway 66 and the exterior of the container 12. A plug 70 is inserted into the central opening of the stopper 58 to prevent contaminants from entering the container 12 during shipping.

Figure 8:
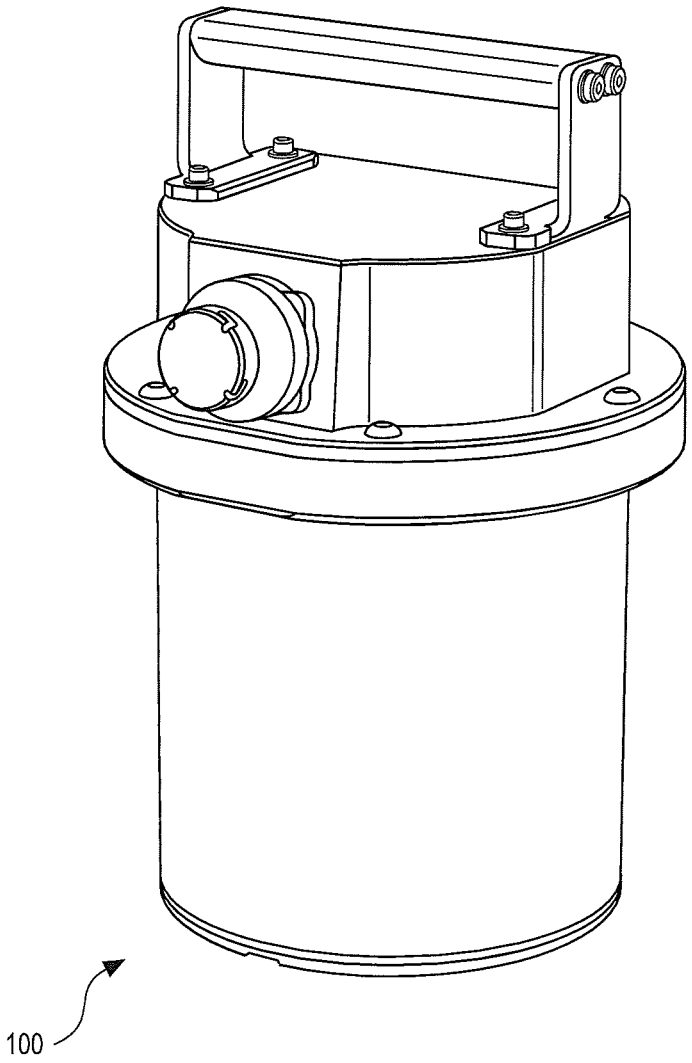
FIG. 8 is a side perspective view of a parent radionuclide container under an alternate embodiment.
Figure 9:
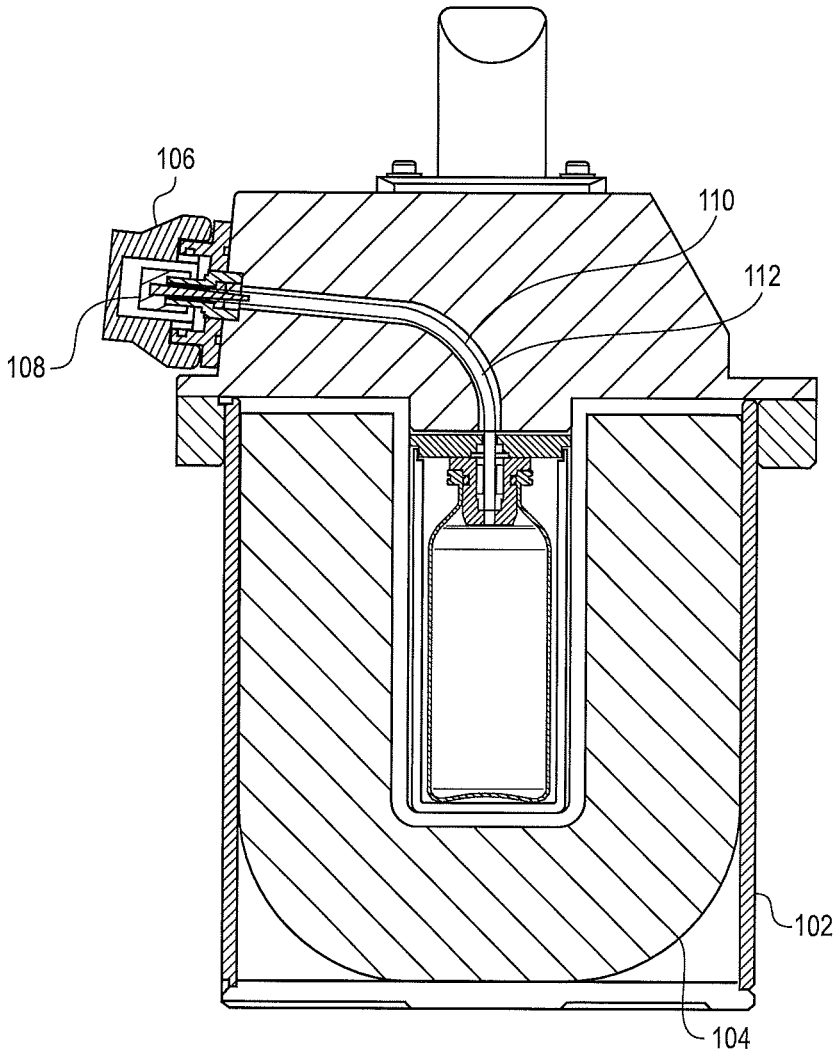
FIG. 9 is a cutaway view of the container of FIG. 8.

FIG. 8 depicts another embodiment of the storage container 12. FIG. 9 is a cutaway side view of the container of FIG. 8. As shown in FIG. 9, the storage container may include an outer shielding layer 102 of a metallic substance (e.g., tungsten) and an inner shielding layer 104 of a lighter material (e.g., plastic).

The container of FIG. 9 may include a curved passageway 110 that connects the vial inside the container with an aperture extending through the outer wall of the container. A tube 112 that is slightly smaller (e.g., 1/16") extends from the aperture to the top of the vial. The tube allows the vial to be filled while the slightly larger passageway allows air to escape from the vial as it is filled.

A plug 108 is inserted into the aperture. A removable cap 106 prevents accidental removal of the plug. The removable cap may have an aperture covered by a filter that allows the pressure inside the vial to equalize with atmospheric pressure The first tube 112 allows a second, slightly smaller tube to be inserted through the first tube and into the vial. The second, slightly smaller may be connected with the tube 60 of FIG. 1 for removal of the parent material from the container 12 for preparation of the daughter radionuclide.

In general, providing the container includes providing a radiation impervious case, disposing a vial that holds a parent radionuclide within the case, venting the vial along a curved path between the vial and a stopper that is external to the case and connecting a fill tube between the vial and external stopper, said fill tube at least partially following the curved path of the vent.

The system includes a container suited for a parent radionuclide, the container further includes a radiation impervious case, a vial disposed within the radiation impervious case that holds the parent radionuclide within the case, a passageway extending along a curved path between the vial and a stopper that is external to the case and a fill tube that extends along the passageway between the vial and external stopper, said fill tube at least partially following the curved path of the vent.

A specific embodiment of method and apparatus for generating radionuclides has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention and any and all modifications, variations, or equivalents that fall within the true spirit and scope of the basic underlying principles disclosed and claimed herein.

The invention claimed is:

1. A method comprising:

providing a radiation impervious case;

disposing a vial that holds a parent radionuclide within the case;

venting the vial through a filter in a stopper that is external to the case along a curved path through the case between the filter and the vial and where the curved path eliminates any line of sight radiation leakage from the vial through the stopper; and connecting a fill tube between the vial and external stopper, said fill tube at least partially following the curved path of the vent.

2. The method as in claim 1 further comprising removing the parent radionuclide from the vial by inserting a fluid withdrawal tube through the fill tube.

3. The method as in claim 1 further comprising dividing the radiation impervious case into two parts and providing an offset in a line of separation to eliminate line-of-sight radiation from escaping through seams in the container.

4. An apparatus comprising:

a radiation impervious case;

a vial for a radionuclide disposed within the case;

a stopper with a central bore, the central bore aligned at an oblique angle with respect to the case so that a straight line through the central bore does not pass through any part of the vial; and a curved tube that connects the central bore of the stopper and a cap of the vial.

5. The apparatus of claim 4 wherein the radiation imperious case further comprises first and second halves divided by a dividing line with an offset that prevents line-of-sight radiation from escaping along the dividing line.

6. The apparatus of claim 4 further comprising a vent passageway extending from the central bore of the stopper into an opposing side of the radiation impervious case.

7. The apparatus of claim 4 further comprising a second tube with a relative smaller outside diameter than an inner diameter of the curved tube, the second tube being inserted into the vial through the curved tube to remove a parent radionuclide from the vial.

8. An apparatus comprising:

a container suited for a parent radionuclide, the container further comprising:

a radiation impervious case;

a vial disposed within the radiation impervious case that holds the parent radionuclide within the case;

a passageway extending along a curved path between the vial and a stopper that is external to the case; and a fill tube that extends along the passageway between the vial and external stopper, said fill tube at least partially following the curved path of the vent.

9. The apparatus as in claim 8 further comprising a fluid withdrawal tube extending through the fill tube that removes the parent radionuclide from the vial.

10. The apparatus as in claim 8 further comprising the radiation impervious case divided into two parts and an offset provided in a line of separation to eliminate line-of-sight radiation from escaping the container.

* * * * *